US005688580A

United States Patent [19]

Fukumoto

[11] Patent Number: 5,688,580

[45] Date of Patent: Nov. 18, 1997

[54] INTERIOR MATERIAL FOR TUNNELS AND TUNNEL INTERIOR CONSTRUCTION

[75] Inventor: Masafumi Fukumoto, Amagasaki, Japan

[73] Assignee: Nisshin Chemical Industry, Co. Ltd., Hyogo, Japan

[21] Appl. No.: 602,991

[22] Filed: Feb. 16, 1996

Related U.S. Application Data

[62] Division of Ser. No. 99,218, Jul. 29, 1993, Pat. No. 5,556, 676.

[30] Foreign Application Priority Data

Jan. 22, 1993 [JP] Japan ..... 5-1288

[51] Int. Cl.[6] ..... B32B 23/02

[52] U.S. Cl. ..... 428/193; 442/94

[58] Field of Search ..... 428/192, 193, 428/228, 251, 421, 422; 442/94

[56] References Cited

U.S. PATENT DOCUMENTS 4,961,991 10/1990 Howard ..... 428/251
5,556,676 9/1996 Fukumoto ..... 428/36.1

*Primary Examiner*—James J. Bell
*Attorney, Agent, or Firm*—Schweitzer Cornman Gross & Bondell LLP

[57] ABSTRACT

An element for lining the interior surface of a tunnel, which comprises a composite panel in which a fibrous layer is laminated over a hard substrate, and a fluoropolymer surface layer is laminated over said fibrous glass layer.

11 Claims, 2 Drawing Sheets

INTERIOR MATERIAL FOR TUNNELS AND TUNNEL INTERIOR CONSTRUCTION

This is a divisional of application for U.S. patent application Ser. No. 08/099,218, filed on Jul. 29, 1993, now issued as U.S. Pat. No. 5,556,676.

FIELD OF THE INVENTION

The present invention relates to tunnel lining elements and lined tunnel structures made with such elements.

BACKGROUND OF THE INVENTION

The interior walls of tunnels, such as vehicular tunnels are often lined to provide improved appearance and for better lighting. The surfaces of such lined tunnels SOON become contaminated by the adherence of soot and dust from the exhaust gas of passing vehicles, and the liners lose their interior functionability and require periodic cleaning. However, because it is difficult to remove the stains from the conventional interior tunnel liner material, cleaning operations are time and labor consuming, and the use of detergents produces problems of secondary pollution through the discharge of the cleaning water.

SUMMARY OF THE INVENTION

The first objective of the present invention is to provide tunnel liner material and interior tunnel structures which enables extremely easy cleaning of the lined surfaces and provide good fire resistance and desirable lighting effects.

The second objective of the present invention is to provide tunnel liner material and interior tunnel structures which deny easy adhesion of surface contaminants such as soot and dust on the interior surfaces of tunnels lined therewith, and provide for easy washability of adhered stains with ordinary water, and do not require scrubbing with a brush, but require only very simple cleaning operations, such as by the use of road sprinkler vehicles passing through the tunnel.

The third objective of the present invention is to provide good cleaning efficiency when compared to the similar ability of conventional interior materials and conventional interior structures, to avoid secondary pollution from detergents since no detergent is required for cleaning, and excellent fire resistance and desirable lighting effects are obtainable.

The fourth objective of the present invention is to provide a tunnel lining element which can be easily installed to the surface of the walls of the tunnel.

DESCRIPTION OF THE DRAWING

The invention is described below in greater detail, with reference being had to the drawings, wherein.

It will be recognized that some or all of the figures are schematic representations for purposes of illustration and do not necessarily depict the actual relative sizes or locations of the elements shown.

Figure 1:
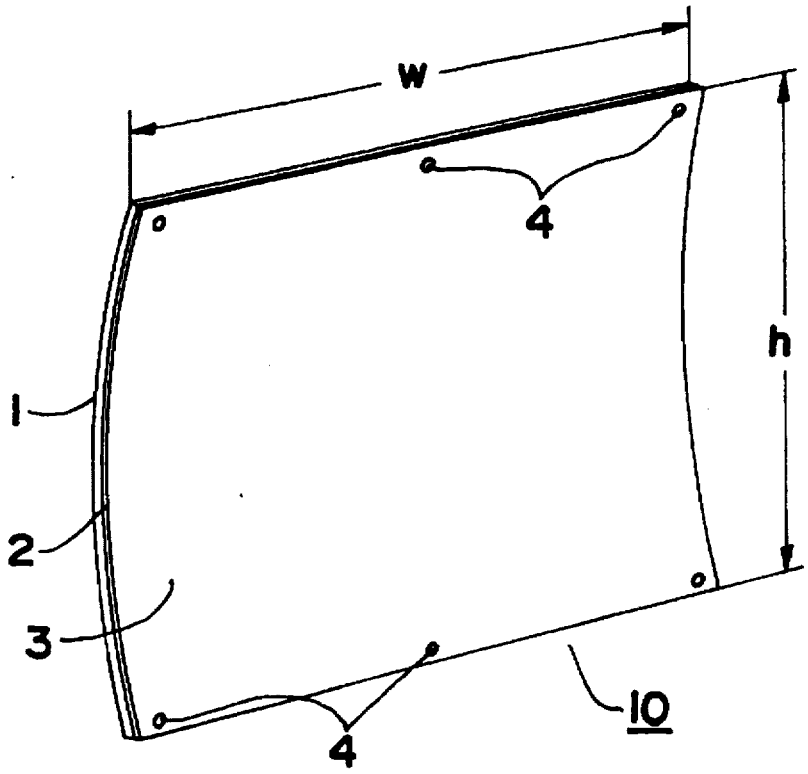
FIG. 1 is perspective view of a tunnel liner element according to a first embodiment of the present invention.
Figure 2:
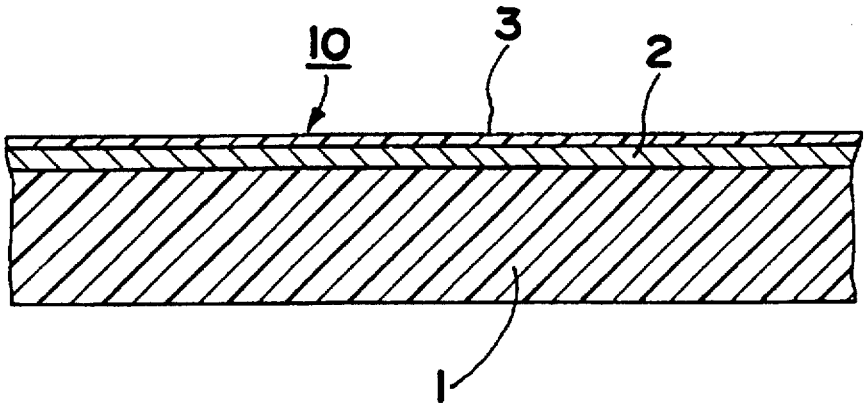
FIG. 2 is a cross sectional view of the tunnel lining element of FIG. 1.

A first embodiment of a tunnel lining element 10 according to the present invention is shown in FIGS. 1 and 2. It is a laminate in which a fibrous glass material, such as woven glass fabric 2 and fluoropolymer film 3 are integrally laminated on a hard substrate 1. The tunnel lining element 10 is a rectangle of about 1–2 meters high (h) and about 105 meters wide (w) at its longitudinal side. The element is curved about its height with the fluoropolymer film 3 side of the element being the concave side of the curvature. The purpose of the curvature is to fit against the inner, curved wall surface of the tunnel to be lined. The top and the bottom of the liner element 10 is provided with mounting holes 4.

The thickness of the hard substrate 1 is suitably from about 2 to about 8 mm, that of the woven glass fabric 2 is suitably from about 0.1 to about 2 mm, that of the fluoropolymer film 3 is suitably from about 0.1 to about 1 mm, and the overall thickness of the liner element is suitably from about 3 to about 10 mm. There is no special restriction as to the nature of the material of the hard substrate 1. A hard synthetic, substantially inflammable polymer is most suitable, and the resin may be loaded with an aggregate or filler, reinforcing fiber, and the like. The hard substrate 1 itself can also be a sheet laminated from different materials.

The fluoropolymer film 3 can be any suitable polymeric or copolymeric material, such as one or more of polyfluoroethylene sold under trademarks as TEFLON, PTFE, FLUON, etc., copolymers of tetrafluoroethylene and perfluoroalkyl vinyl ether such as sold under the trademark TEFLON PFA, ternary copolymers of tetrafluoro resins, perfluoroalkyl vinyl ether, and propylene hexafluoride such as sold under the trademark TEFLON EPE, copolymers of tetrafluoroethylene and hexafluoropropylene such as sold under the trademark TEFLON FEP, and copolymers of tetrafluorethylene and ethylene, such as sold under the trademark TEFSEL.

An adhesive is generally used to join the hard substrate 1 with the woven glass fabric 2, but as well known to the artisan crimping by heating can also be used when the hard substrate 1 is a synthetic, e.g. thermosetting resin. The woven glass fabric 2 and the fluoropolymer film 3 can be heat-crimped to each other so that they are joined to each other by anchoring effects by which the woven glass fabric 2 bites into the polymeric layer 3 but other known per se means of joining them can also be adopted, as may be required.

Figure 3:
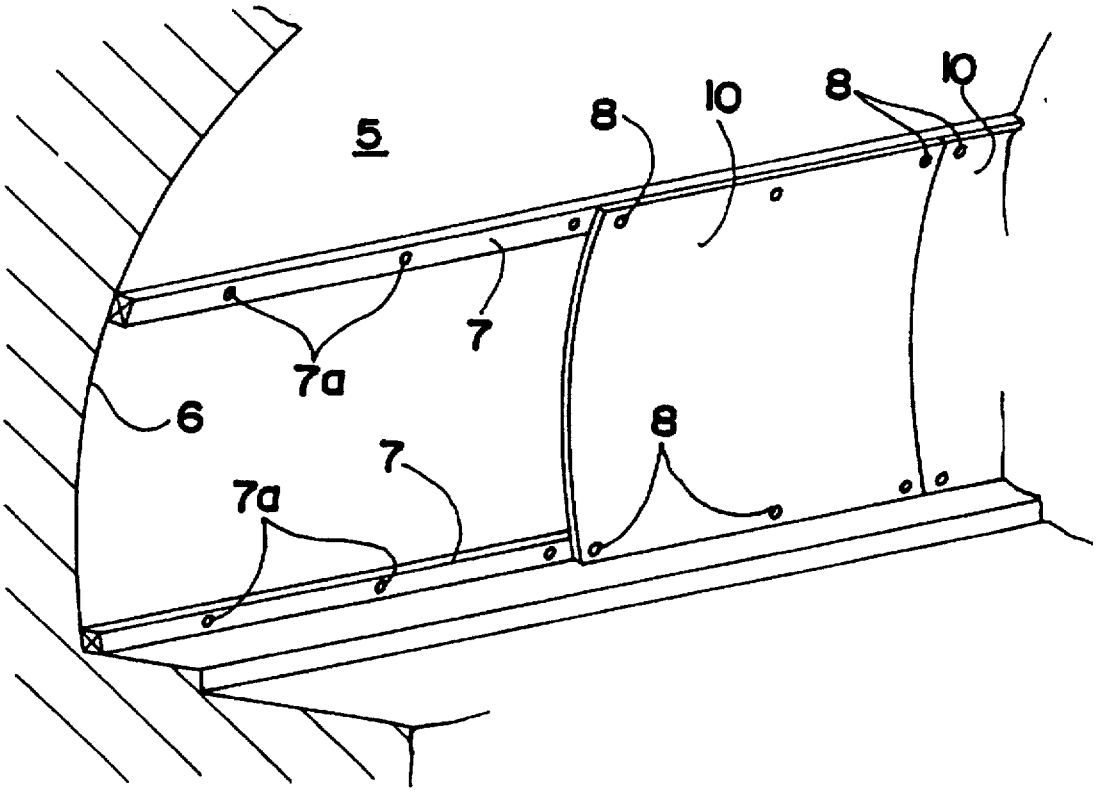
FIG. 3 is a perspective view showing a plurality of tunnel lining element installed on the inner wall of a tunnel.
Figure 4:
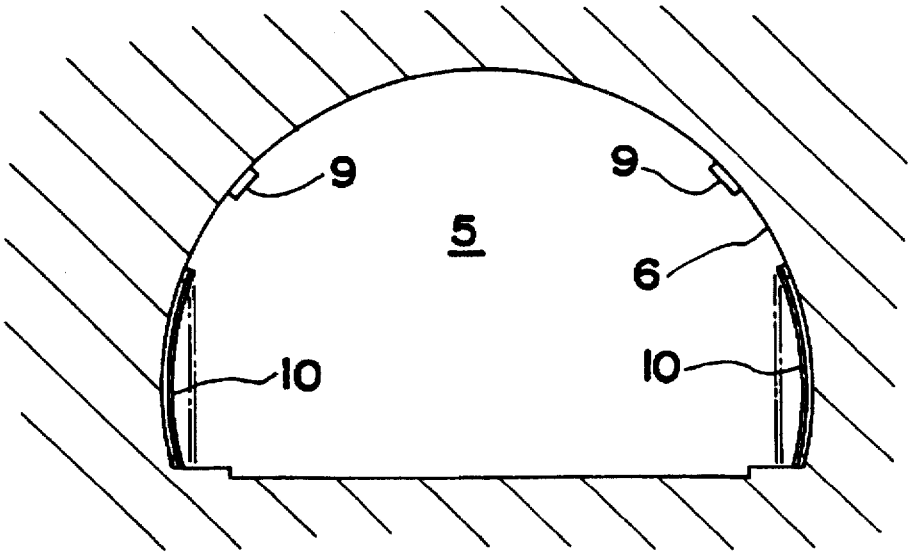
FIG. 4 is a cross-sectional view of a tunnel showing the installed liner elements of both embodiments of the present invention.

The tunnel liner element 10 is affixed onto the inner wall 6 of the tunnel 5 by liner mounting means such as strips or frame elements 7, suitably containing predrilled screw holes 7*a* arranged horizontally at the top and the bottom frame elements as shown in FIG. 3. The tunnel liner elements 10 are attached to the liner mounting frame elements 7 with liner mounting screws 8, suitably machine screws, ranging through the holes 4. Suitably fluoropolymer screws 8 are employed for improved corrosion resistance and due to their antifouling properties. FIG. 4 shows the cross section of the tunnel 5 after the installation of liner elements 10 on the inner walls 6 on both side of the tunnel 5, with lighting fixtures 9 in position.

In the embodiment of the invention just described, the tunnel liner element 10 is curved. According to another embodiment of the invention it can also be a flat plate. Therefore, to install a flat tunnel liner element on the surface of the curved interior wall of the tunnel, the liner element can be arranged to provide a clearance between it and the interior wall 6, as the straight liner is shown in FIG. 4 in broken lines.

In either embodiment of the present invention the tunnel liner element 10 can be attached to the tunnel by any other one or more means than the screwing, such as by anchoring, nailing, bonding with adhesives, clipping, sucker bolts, frame fitting, and the like.

The fluoropolymer surface 3 of the tunnel finer element 10 of the present invention will not attract soot or dust, because the fluoropolymer is both chemically and physically very inactive, and even if some soot or dust might adhere to it, the surface deposits can be easily washed off with a spray of plain water due to the weak interaction with the fluoropolymer surface. Consequently, no detergent and not even scrubbing with a bush is generally required to wash off any contaminant deposits from the surface of the tunnel lined in accordance with the present invention. Thus, for example, a road sprinkler vehicle passing through the tunnel and sprinkling water over the interior material surface will be sufficient to restore the original finish of the fluoropolymer surface.

The tunnel liner element 10 is designed to enable its hard substrate 1 to hold the shape of the element. The woven glass fabric 2 laminated between the substrate 1 and the fluoropolymer film 3, improves the already good fire resistance of the tunnel liner element. The fluoropolymer surface 3 has a milky white color or is pigmented and this color contributes to good fighting effects within the tunnel, as well as to an attractive, no maintenance requiring interior finish.

Although the present invention has been described in terms of it suitable embodiments, it is to be understood that such disclosure is not to be interpreted as limiting. Various alterations and modifications can become apparent to those skilled in the art after having read the above disclosure. Accordingly, the appended claims define the scope of the invention.

I claim:

1. An element, which comprises a composite panel in which a fibrous glass material is laminated over a hard substrate, and a fluoropolymer surface layer is laminated over said fibrous glass material.

2. The element of claim 1, wherein said panel is substantially rectangular having a longer and a shorter dimension, and said panel is curved toward its fluoropolymer surface layer.

3. The element of claim 2, wherein said fibrous glass material is of a woven glass fiber, and said curve in said panel is about its longer dimension.

4. The element of claim 1, wherein said panel is flat.

5. The element of claim 1, wherein said fibrous glass material is of a woven glass fiber layer.

6. The element of claim 1, further comprising a plurality of mounting holes along one or more edges thereof.

7. The element of claim 5, wherein the substrate is from about 2 to about 8 mm thick, the woven glass fiber layer is from about 0.1 to about 2 mm thick, and the fluropolymer surface layer is from about 0.1 to about 1 mm thick.

8. The element of claim 7, wherein the overall thickness of the element is from about 3 to about 10 mm.

9. The element of claim 1, wherein said fluropolymer is one or more of the materials tetrafluoroethylene, perfluoralkyl vinyl ether, ternary copolymers of tetrafluoro resins, perfluoroalkyl vinyl ether, propylene hexafluoride, copolymers tetrafluorethylene and hexafluropropylene, and copolymers of tetrafluorethylene and ethylene.

10. The element of claim 1, further comprising means for attaching the element to the substrate.

11. The of claim 10, wherein said means for attaching comprises mounting holes, or mounting screws, or both mounting holes and mounting screws, said screws being optionally of a fluropolymer.

* * * * *